US009234361B2

(12) United States Patent
Staten et al.

(10) Patent No.: US 9,234,361 B2
(45) **Date of Patent: *Jan. 12, 2016**

(54) POWERED TELESCOPIC SEATING RISER ASSEMBLY

(71) Applicant: Stageright Corporation, Clare, MI (US)

(72) Inventors: Kenneth Edward Staten, Clare, MI (US); Orley David Rogers, Sanford, MI (US)

(73) Assignee: Stageright Corporation, Clare, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/299,379

(22) Filed: Jun. 9, 2014

(65) Prior Publication Data

US 2014/0283458 A1 Sep. 25, 2014

Related U.S. Application Data

(63) Continuation of application No. 13/899,727, filed on May 22, 2013, now Pat. No. 8,782,959, which is a continuation of application No. 13/010,067, filed on Jan. 20, 2011, which is a continuation of application No. 11/542,753, filed on Oct. 4, 2006, now Pat. No. 7,900,402.

(51) Int. Cl.
*E04H 3/12* (2006.01)
*E04B 1/38* (2006.01)

(52) U.S. Cl.
CPC *E04H 3/123* (2013.01); *E04B 1/38* (2013.01); *E04H 3/126* (2013.01)

(58) Field of Classification Search
CPC ..... E04H 3/123; E04H 3/28; E04H 3/126; A63J 1/00; E04B 1/38
USPC ..... 52/6, 8, 9, 10
See application file for complete search history.

(56) References Cited

U.S. PATENT DOCUMENTS

| | | | | | |
|---|---|---|---|---|---|
| 2,898,639 | A | * | 8/1959 | Murphy | 52/10 |
| 2,968,842 | A | * | 1/1961 | Murphy | 52/10 |
| 2,990,587 | A | * | 7/1961 | Murphy | 52/10 |
| 3,069,732 | A | * | 12/1962 | Murphy | 52/10 |
| 3,083,582 | A | | 4/1963 | Wheeler | |
| 3,107,398 | A | * | 10/1963 | Murphy | 52/10 |
| 3,213,570 | A | | 10/1965 | Abramson, Jr. | |
| 3,429,081 | A | * | 2/1969 | McClelland et al. | 52/9 |
| 3,464,753 | A | * | 9/1969 | Van Ryn | 297/232 |
| 3,488,898 | A | * | 1/1970 | Scaggs | 52/10 |
| 3,561,177 | A | * | 2/1971 | Agro et al. | 52/169.14 |
| 3,697,633 | A | * | 10/1972 | Edgar | 264/45.3 |
| 3,748,798 | A | | 7/1973 | Mackintosh | |
| 4,000,586 | A | * | 1/1977 | Vance et al. | 52/9 |
| 4,063,392 | A | * | 12/1977 | Van Ryn et al. | 52/9 |
| 4,285,172 | A | * | 8/1981 | Quigley | 52/10 |
| 4,343,846 | A | * | 8/1982 | Kohn | 428/138 |
| 4,409,762 | A | * | 10/1983 | Raymond | 52/9 |

(Continued)

*Primary Examiner* — Basil Katcheves
*Assistant Examiner* — Joshua Ihezie
(74) *Attorney, Agent, or Firm* — Carlson, Gaskey & Olds, P.C.

(57) ABSTRACT

A riser assembly according to an exemplary aspect of the present disclosure includes, among other things, a first skin. A second skin is spaced from the first skin. A core is disposed between the first skin and the second skin. A framework is disposed between the first skin and the second skin. A portion of the framework is positioned laterally outside the core. A method of supporting an accessory relative to a riser assembly is also disclosed.

25 Claims, 14 Drawing Sheets

(56) References Cited

U.S. PATENT DOCUMENTS

| | | | | | |
|---|---|---|---|---|---|
| 4,446,659 | A | * | 5/1984 | Quigley | 52/9 |
| 4,490,949 | A | * | 1/1985 | Sutter et al. | 52/9 |
| 4,638,604 | A | * | 1/1987 | Rogers et al. | 52/6 |
| 4,729,599 | A | * | 3/1988 | Nissen | 297/219.1 |
| 4,843,792 | A | * | 7/1989 | Rogers et al. | 52/127.7 |
| 4,930,277 | A | * | 6/1990 | Krumholz et al. | 52/263 |
| 4,942,708 | A | * | 7/1990 | Krumholz et al. | 52/263 |
| 4,979,340 | A | * | 12/1990 | Wilson et al. | 52/9 |
| 5,069,007 | A | | 12/1991 | Paddock | |
| 5,139,845 | A | * | 8/1992 | Beckerman et al. | 428/117 |
| 5,205,087 | A | * | 4/1993 | Jines | 52/6 |
| 5,323,564 | A | * | 6/1994 | Mensching et al. | 52/7 |
| 5,381,873 | A | | 1/1995 | Kniefel et al. | |
| 5,467,840 | A | | 11/1995 | Becher et al. | |
| 5,559,411 | A | * | 9/1996 | Winship | 318/466 |
| 5,673,518 | A | * | 10/1997 | Paddock | 52/9 |
| 5,692,445 | A | | 12/1997 | Winer | |
| 5,796,052 | A | | 8/1998 | Christmann | |
| 5,848,501 | A | * | 12/1998 | Taipale et al. | 52/126.4 |
| 5,913,776 | A | | 6/1999 | Compagnone | |
| 5,935,675 | A | * | 8/1999 | Hayden et al. | 428/71 |
| 5,960,589 | A | * | 10/1999 | Youngquist et al. | 52/8 |
| 6,029,406 | A | | 2/2000 | Staehlin | |
| 6,050,366 | A | | 4/2000 | Lyons | |
| 6,085,861 | A | | 7/2000 | Jines | |
| 6,106,186 | A | * | 8/2000 | Taipale et al. | 403/322.4 |
| D432,669 | S | | 10/2000 | Bryjak et al. | |
| 6,185,875 | B1 | * | 2/2001 | Victor et al. | 52/9 |
| 6,199,325 | B1 | * | 3/2001 | Winship | 52/10 |
| 6,324,790 | B1 | * | 12/2001 | Victor et al. | 52/9 |
| 6,446,413 | B1 | * | 9/2002 | Gruber | 52/747.11 |
| 6,539,672 | B1 | | 4/2003 | Frost | |
| 6,571,915 | B1 | | 6/2003 | de la Tour | |
| 6,581,339 | B2 | * | 6/2003 | Thiede | 52/126.4 |
| 6,598,351 | B2 | * | 7/2003 | Hallberg | 52/9 |
| 6,615,548 | B1 | | 9/2003 | Nakamure et al. | |
| 6,719,094 | B2 | | 4/2004 | de la Tour | |
| 6,729,075 | B2 | * | 5/2004 | Jines et al. | 52/7 |
| 6,922,947 | B2 | | 8/2005 | Jines et al. | |
| 6,925,760 | B2 | * | 8/2005 | Suprina | 52/9 |
| 7,107,724 | B2 | * | 9/2006 | Suprina et al. | 52/9 |
| 7,107,734 | B2 | * | 9/2006 | Jines et al. | 52/655.1 |
| 7,617,635 | B2 | * | 11/2009 | Jacobs et al. | 52/8 |
| 7,900,402 | B2 | | 3/2011 | Staten et al. | |
| 8,782,959 | B2 | * | 7/2014 | Staten et al. | 52/8 |
| 2003/0009950 | A1 | * | 1/2003 | Hallberg | 52/8 |
| 2003/0038065 | A1 | | 2/2003 | Pippin et al. | |

* cited by examiner

POWERED TELESCOPIC SEATING RISER ASSEMBLY

CROSS REFERENCE TO RELATED APPLICATIONS

This application is a continuation of U.S. patent application Ser. No. 13/899,727, filed May 22, 2013, which is a continuation of U.S. patent application Ser. No. 13/010,067, filed Jan. 20, 2011, which is a continuation of U.S. patent application Ser. No. 11/542,753, now U.S. Pat. No. 7,900,402, filed Oct. 4, 2006.

BACKGROUND

This disclosure relates to portable seating systems and, more particularly, to a powered telescopic seating riser assembly for a seating system with a multiple of seating configurations drivable between at least an extended position and a stored position.

Seating risers are designed for use in auditoriums, gymnasiums, and event halls to accommodate spectators on portable seats, such as folding chairs. Depending on the intended use, a facility may require seating risers that are capable of being moved from a retracted position for storage, to an extended position for use.

Heretofore, many conventional seating riser structures have been utilized for nonpermanent seating. These conventional systems generally utilize a series of assemblies having seating risers of given heights which store within close proximity to one another.

Because of the temporary nature of the seating used by some organizations and the large storage area required to house non-permanent seating systems when not extended for use, it is desirable to provide a variety of seating configurations with a single non-permanent seating system. With conventional non-permanent seating systems, several assemblies are placed adjacent one another, for instance, to form the seating along an athletic playing surface. Although modular in this sense, conventional non-permanent seating systems have a rise always constant with respect to the run.

Some conventional non-permanent seating systems are manually deployed. Although effective, significant manpower and time is typically required to deploy and store the system. Manual deployment and storage may be further complicated by the requirement that the non-permanent seating system needs to be deployed in a generally coordinated manner, otherwise, binding or other complications may result. Since the non-permanent seating system by its vary nature is a relatively large structure, coordination during manual deployment and storage coordination may be relatively difficult.

Other conventional non-permanent seating systems drive a wheel system thereof. Such drives require friction with a floor surface such that non-uniform traction may also result in the aforementioned binding.

SUMMARY

A riser assembly according to an exemplary aspect of the present disclosure includes, among other things, a first skin and a second skin spaced from the first skin. A core is disposed between the first skin and the second skin, the core including a plurality of subpanels. A framework including a plurality of beams is disposed between the first skin and the second skin. The core is received within a space defined by the framework, and a portion of the framework is positioned laterally outside the core. Each of the plurality of subpanels is received within one of a plurality of spaces defined by the framework. The plurality of beams defines a perimeter about each of the subpanels. The first skin, second skin and framework enclose the core. The first skin and the second skin are separate and distinct from the framework.

In a further non-limiting embodiment of the foregoing riser assembly, the first skin includes a first material, the second skin includes a second material, and the core includes a third material different from the first and second materials in composition.

In a further non-limiting embodiment of the foregoing riser assembly, the third material includes an end-grained balsawood.

In a further non-limiting embodiment of any of the foregoing riser assemblies, the core comprises a honeycomb structure.

In a further non-limiting embodiment of any of the foregoing riser assemblies, an access track beam is arranged adjacent to the framework. The access track beam defines a longitudinal slot extending at least partially between each end of the access track beam. The longitudinal slot is configured to selectively receive a mountable accessory.

In a further non-limiting embodiment of any of the foregoing riser assemblies, each of the first and second skins is glued to the core.

In a further non-limiting embodiment of any of the foregoing riser assemblies, each of the first and second skins is attached to the framework.

In a further non-limiting embodiment of any of the foregoing riser assemblies, each of the first and second skins is welded to the framework.

In a further non-limiting embodiment of any of the foregoing riser assemblies, each of the first and second skins has a substantially identical cross-section profile spanning the core and the framework.

In a further non-limiting embodiment of any of the foregoing riser assemblies, the first skin, the second skin and the framework define a first deck surface. The framework extends below a second deck surface vertically spaced from the first deck surface. The framework extends substantially between a front facing edge and a rear facing edge of the second deck surface.

A riser assembly according to another exemplary aspect of the present disclosure includes, among other things, an upper framework and a lower framework spaced vertically relative to the upper framework and extending substantially between a front facing edge and a rear facing edge of the upper framework, and a deck surface. An access beam is exposed. The access beam defines a longitudinal slot together with the upper framework to receive a riser assembly accessory.

In a further non-limiting embodiment of the foregoing riser assembly, the deck surface includes a first skin.

In a further non-limiting embodiment of any of the foregoing riser assemblies, the deck surface is a first deck surface, and a second deck surface is positioned in a stepped arrangement relative to the first deck surface.

In a further non-limiting embodiment of any of the foregoing riser assemblies, the first deck surface is attached to the second deck surface to minimize relative movement therebetween.

In a further non-limiting embodiment of any of the foregoing riser assemblies, the deck surface is attached to the lower framework.

In a further non-limiting embodiment of any of the foregoing riser assemblies, the access track beam is arranged adjacent to the upper and lower frameworks. The access track beam defines a longitudinal slot extending at least partially between each end of the access track beam.

In a further non-limiting embodiment of any of the foregoing riser assemblies, the access track beam is arranged adjacent to the upper and lower frameworks. The access track beam defines a longitudinal slot extending at least partially between each end of the access track beam.

In a further non-limiting embodiment of any of the foregoing riser assemblies, a side of the access track beam is attached to the upper and lower frameworks.

In a further non-limiting embodiment of any of the foregoing riser assemblies, the access track beam defines at least one flange extending inward from the longitudinal slot.

In a further non-limiting embodiment of any of the foregoing riser assemblies, the riser assembly accessory is chair beam mounting system secured to the access beam.

In a further non-limiting embodiment of any of the foregoing riser assemblies, the longitudinal slot is defined by a first channel formed in an upper surface of the access track beam and is also defined by a second channel formed in a lower surface of the upper framework.

In a further non-limiting embodiment of any of the foregoing riser assemblies, the access track beam extends across and is attached to a plurality of ribs extending substantially between the front facing edge and the rear facing edge of the upper framework.

In a further non-limiting embodiment of any of the foregoing riser assemblies, the lower framework extends at least partially below the access track beam.

A method of supporting an accessory relative to a riser assembly according to another exemplary aspect of the present disclosure includes, among other things, selectively attaching an accessory to a longitudinal slot defined by a forward facing access track beam that is positioned in a vertical relationship relative to a first deck panel. The longitudinal slot is also defined by a framework of a second deck panel spaced vertically from the first deck panel.

In a further non-limiting embodiment of the foregoing method includes selectively attaching an accessory to a longitudinal slot defined by a forward facing access track beam that is positioned in a vertical relationship relative to a first deck panel. The longitudinal slot is also defined by a framework of a second deck panel spaced vertically from the first deck panel.

In a further non-limiting embodiment of any of the foregoing methods, the longitudinal slot is defined by a first channel formed in an upper surface of the access track beam and is also defined by a second channel formed in a lower surface of the framework.

In a further non-limiting embodiment of any of the foregoing methods, the longitudinal slot is a first longitudinal slot spaced from a second longitudinal slot also defined by the access track beam.

In a further non-limiting embodiment of any of the foregoing methods, the access track beam is attached to the framework.

In a further non-limiting embodiment of any of the foregoing methods, access track beam is separate and distinct from the framework.

In a further non-limiting embodiment of any of the foregoing methods, the access track beam extends across a plurality of ribs vertically spacing the first deck panel and the second deck panel.

In a further non-limiting embodiment of any of the foregoing methods, each of the plurality of ribs extends substantially between a front facing edge and a rear facing edge of the framework of the second deck panel.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION

Figure 1:
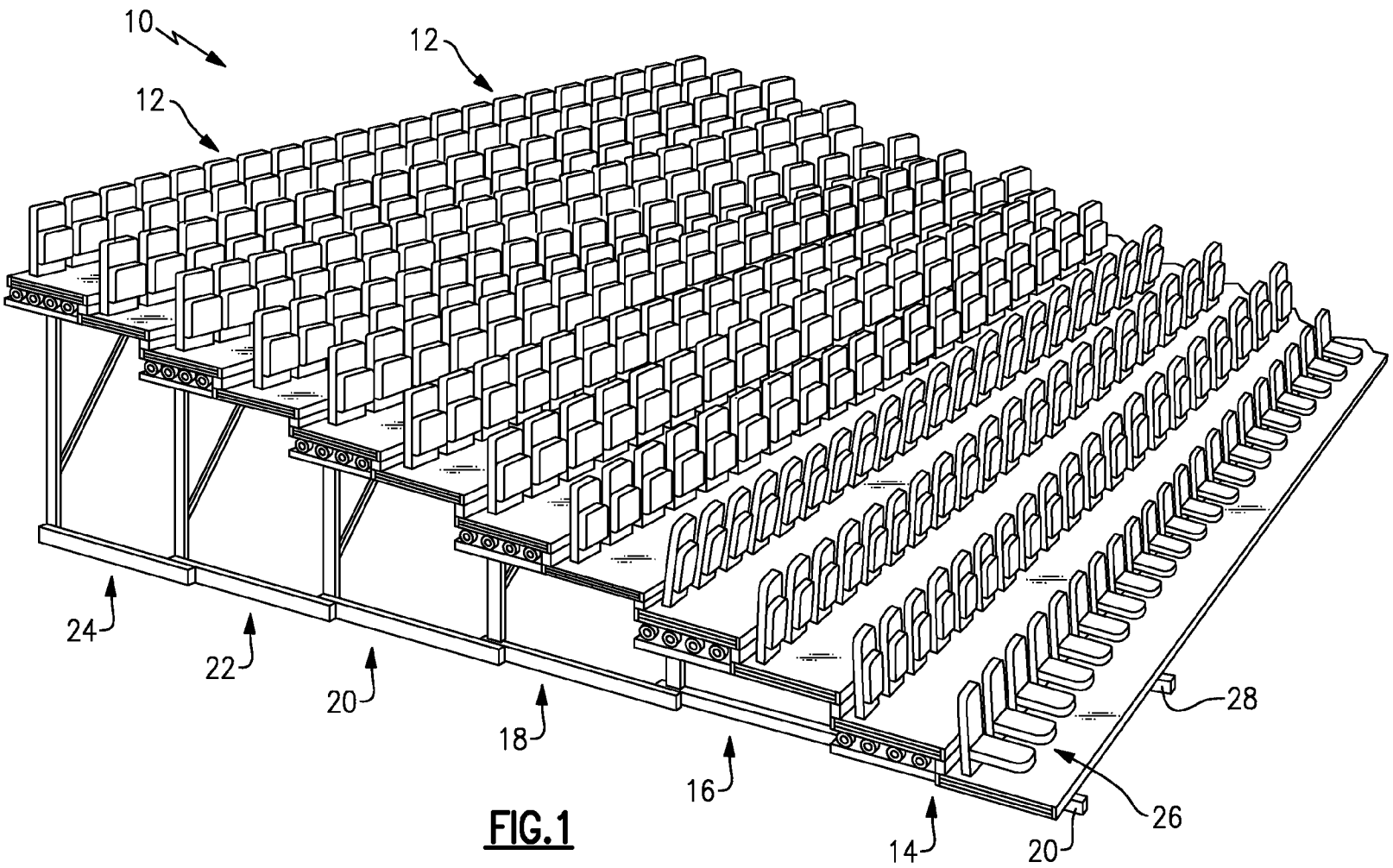
FIG. 1 is a perspective view of a non-permanent seating system in a deployed position.

FIG. 1 illustrates a general perspective view of a non-permanent seating system 10 having a multiple of telescopic seating riser systems 12. The telescoping seating riser system 12 forms the fundamental building blocks of the system 10. The system 12 may stand alone, or may stand side by side. It will be appreciated that the height thereof is dependent on design choices including the desired rise.

Each telescopic seating riser system 12 generally includes an innermost lower riser assembly 14, and successive outer elevated riser assemblies 16-24. It will be appreciated that the number of riser assemblies 14-24 in any given telescopic seating riser system 12 will be a matter of design requirements. Each riser assembly 14-24 generally includes a dual deck surface 26 and a pair of telescopic leg assemblies 28.

Figure 2A:
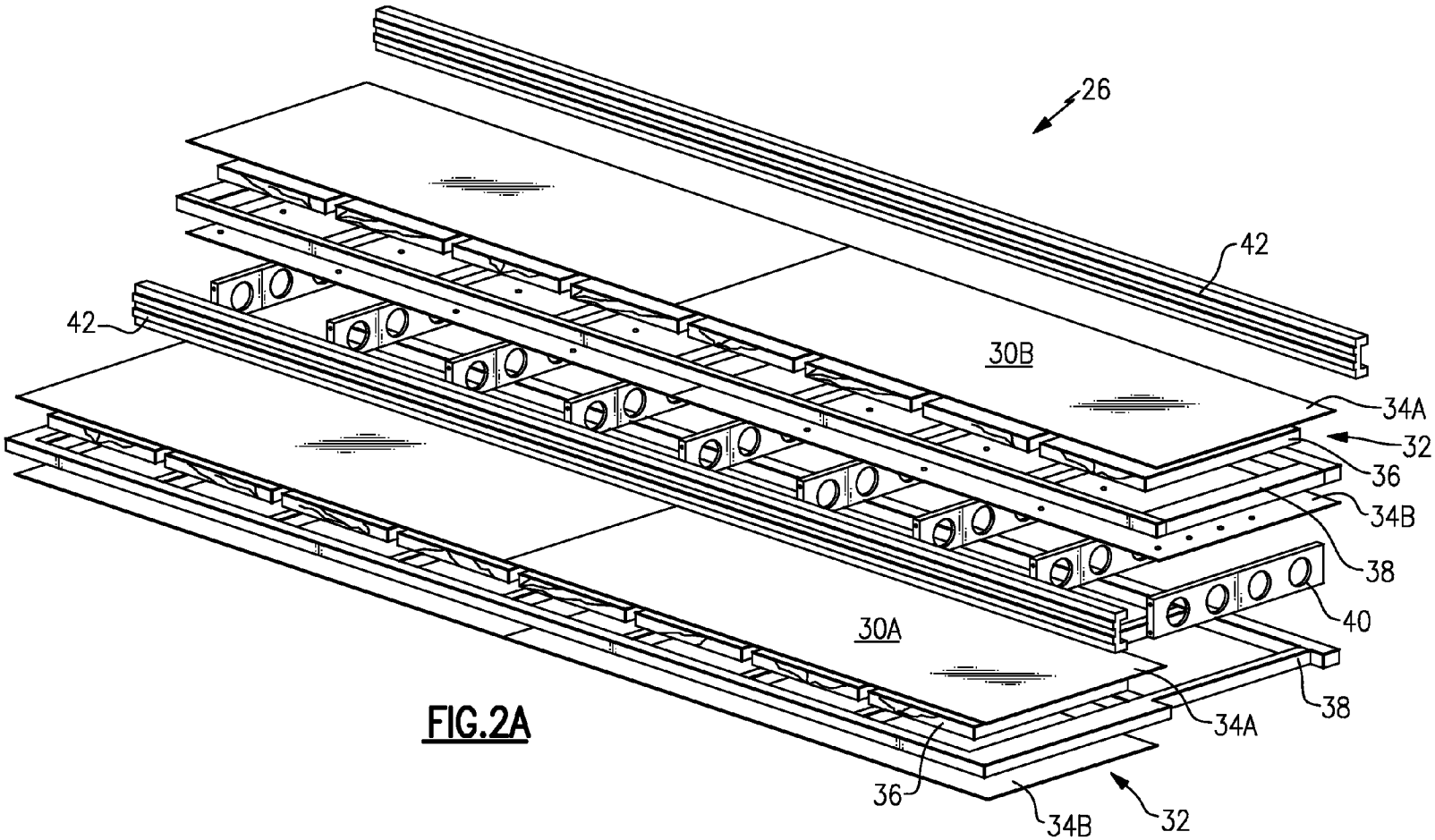
FIG. 2A is an exploded view of a dual deck surface.
Figure 2B:
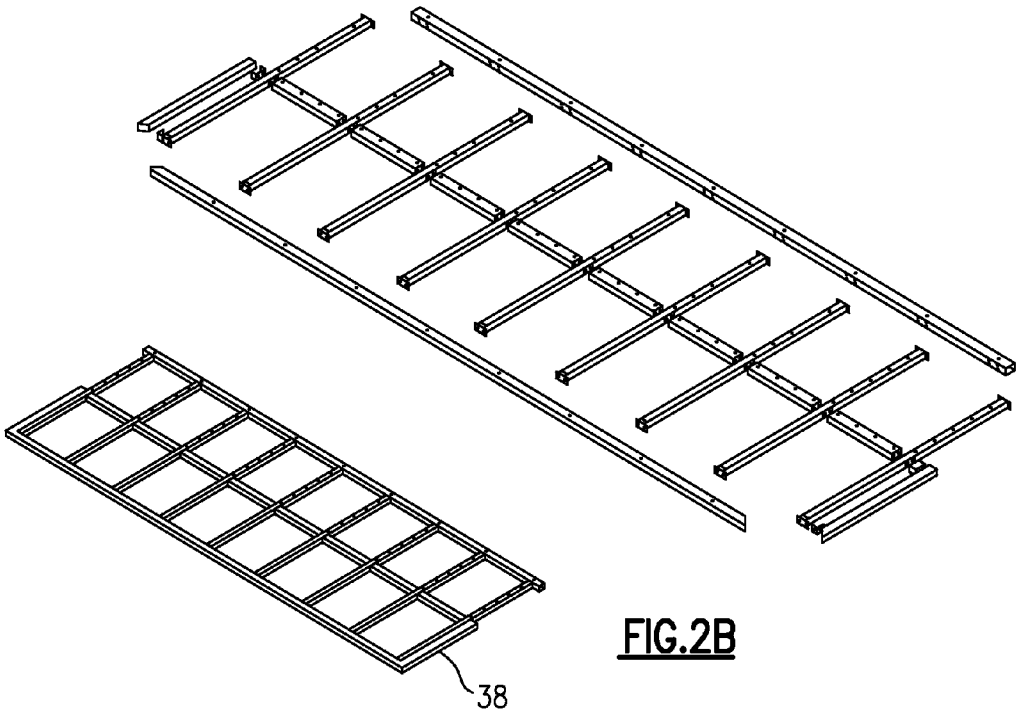
FIG. 2B is a perspective view of a frame of the dual deck surface of FIG. 2A.

Referring to FIG. 2A, the dual deck surface 26 includes a lower deck surface 30A and an upper deck surface 30B arranged in a stepped arrangement. The lower deck surface 30A and the upper deck surface 30B each establish a respective deck plane. The dual deck surface 26 generally utilizes a sandwich structure for each deck panel 32. The deck panel 32 is manufactured of an upper and lower deck skin 34A, 34B which sandwiches a core 36. The skins 34A, 34B are preferably manufactured of aluminum while the core 36 is formed of an end-grained balsawood or a honeycomb structure to provide a strong, lightweight and acoustically absorbent structure. The deck panels 32 are mounted to a framework 38 (FIG. 2B) which support a multiple of ribs 40 between a set of longitudinal access track beams 42 (also illustrated in FIG. 2C). The core 36 may include a plurality of subpanels 37 (illustrated in FIG. 2A) each configured to be received within a space defined by the framework 38.

The multiple of ribs 40 provide the dual deck surface 26 by vertically separating the lower deck panel 32L from the upper deck panels 32U. Each riser assembly 14-24 includes one dual deck surface 26 with one lower deck panel 32L and one upper deck panel 32U to provide seating on two levels.

Figure 2C:
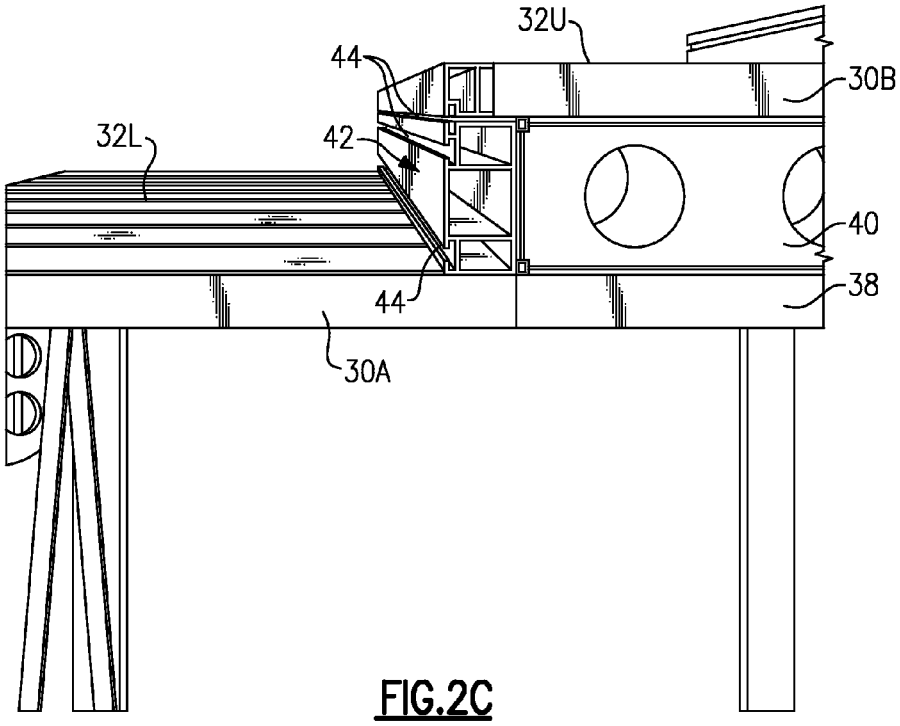
FIG. 2C is a sectional view through the dual deck surface illustrating an access track beam.

Referring to FIG. 2C, the longitudinal access track beams 42 include slots 44 which receive a chair beam mounting system S (FIG. 2D) such as that utilized in stadium seating systems such as that manufactured by Camatic Pty Ltd. of Wantirna, Australia. The access track beams 42 are arranged in a vertical relationship between each deck panel 32L, 32U to provide space for the seating system 10 when in a stored position. The slots 44 are longitudinally located within the access track beams 42 to provide communication passages for, for example only, aisle lighting, and attachment of, for example only, rails R (FIG. 2F), stair blocks B (FIG. 2F) and the aforementioned chair beam mounting system S.

Figure 3A:
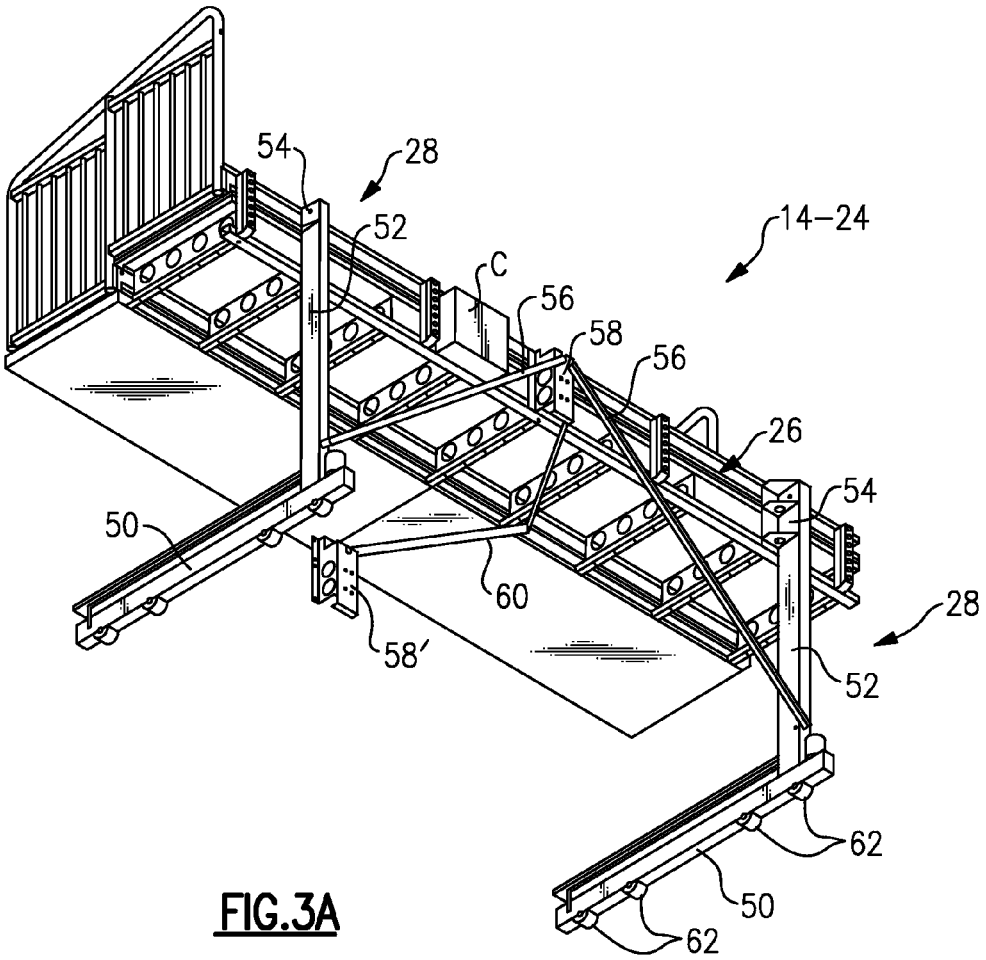
FIG. 3A is a perspective generally bottom view of a single riser assembly.

Referring to FIG. 3A, each telescopic leg assembly 28 includes a horizontal leg 50 and a vertical leg 52. It should be understood that although only a single leg assembly will be described, it should be understood that each leg assembly on each dual elevated riser assemblies 14-24 is generally alike. Notably, each riser assembly 14-24 telescopes under the next higher riser assembly 14-24.

Each vertical leg 52 is attached to the rear of the dual deck surface 26 through a bracket 54. The vertical leg 52 is preferably manufactured of square tubing, however, other shapes may likewise be usable with the present invention.

A set of rear cross members 56 are connected to the vertical leg 52 at their lower end and to the dual deck surface 26 at their upper end through a central bracket 58. The rear cross members 56 further stabilizes each riser assembly 14-24. The central bracket 58 is connected to another central bracket 58' on the next riser assembly 14-24 through an articulatable linkage 60 which articulates in response to telescopic movement of the riser assemblies 14-24. The linkage 60 preferably provides a passage for the communication of power cables, electronic control and the like.

The horizontal leg 50 is supported on wheels 62. Preferably, four wheels 62 are mounted within each of the horizontal legs 50 to allow each riser assemblies 14-24 to readily travel over a floor surface.

Figure 3B:
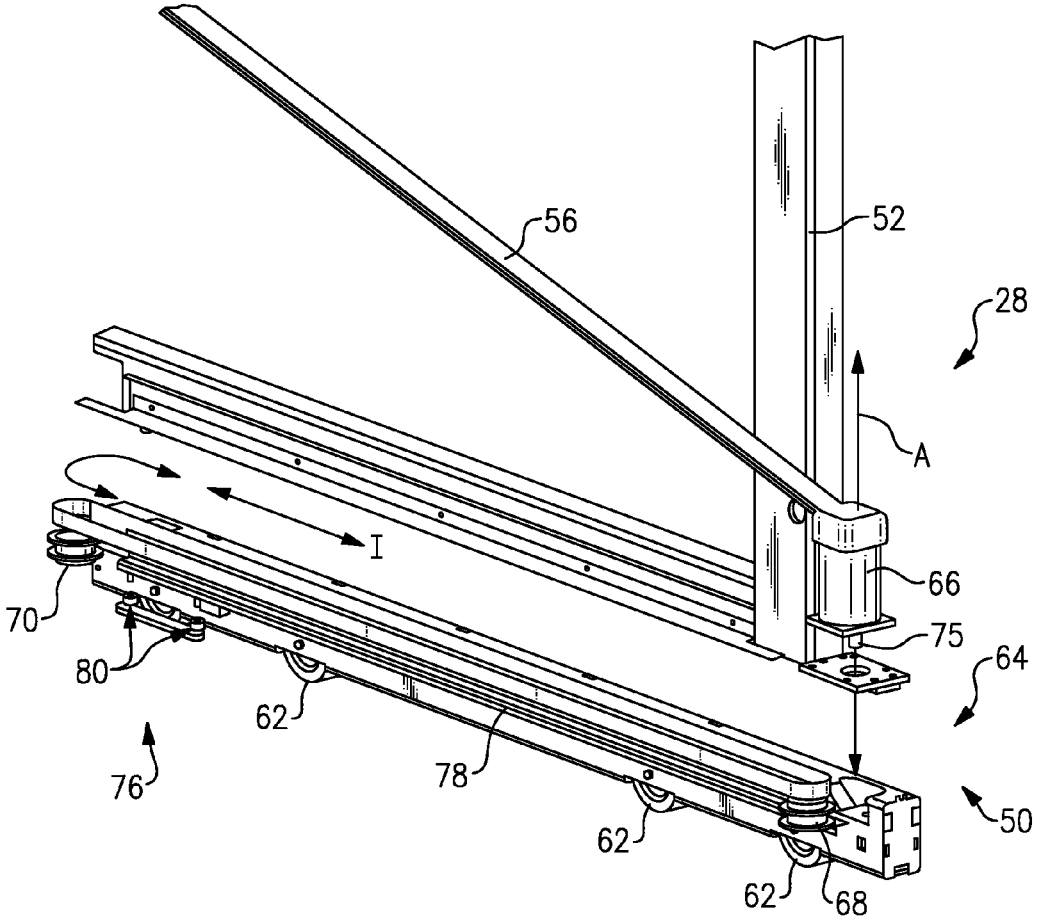
FIG. 3B is an expanded partially exploded view of a horizontal leg of the telescopic leg assembly of the riser assembly.
Figure 3C:
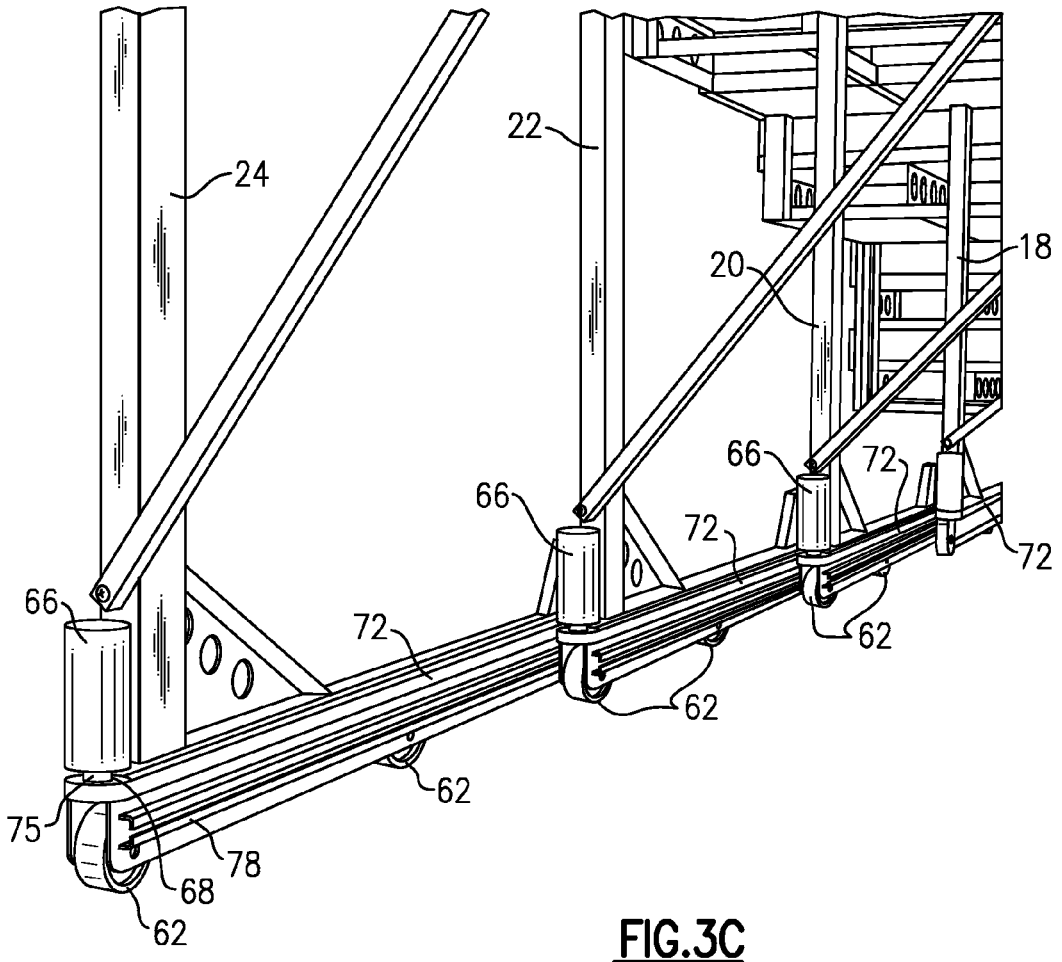
FIG. 3C is a perspective generally underside view of the non-permanent seating system in a deployed position illustrating a belt drive system and the interaction of a timing belt between each of the multiple of riser assemblies.

Referring to FIG. 3B, each horizontal leg 50 of each leg assembly 28 supports a toothed belt drive system 64. The belt drive system 64 includes an electric motor 66, an inner pulley 68, an outer pulley 70 and a toothed timing belt 72 therebetween. The toothed belt drive system 64 provides the interface between each adjacent riser assembly 14-24 (FIG. 3C) and the motive force to extend and retract the riser system 12 in a telescopic manner. The toothed timing belt 72 is continuous in this example. That is, the toothed timing belt 72 is a loop lacking a defined end.

The electric motor 66 is mounted directly aft of the vertical leg 52 in a readily accessible location. Notably, the power cable 67 from the electric motor 66 is preferably threaded through the associated rear cross members 56 to communicate with the central bracket 58 and a controller C preferably on the uppermost riser assembly 24.

Figure 3D:
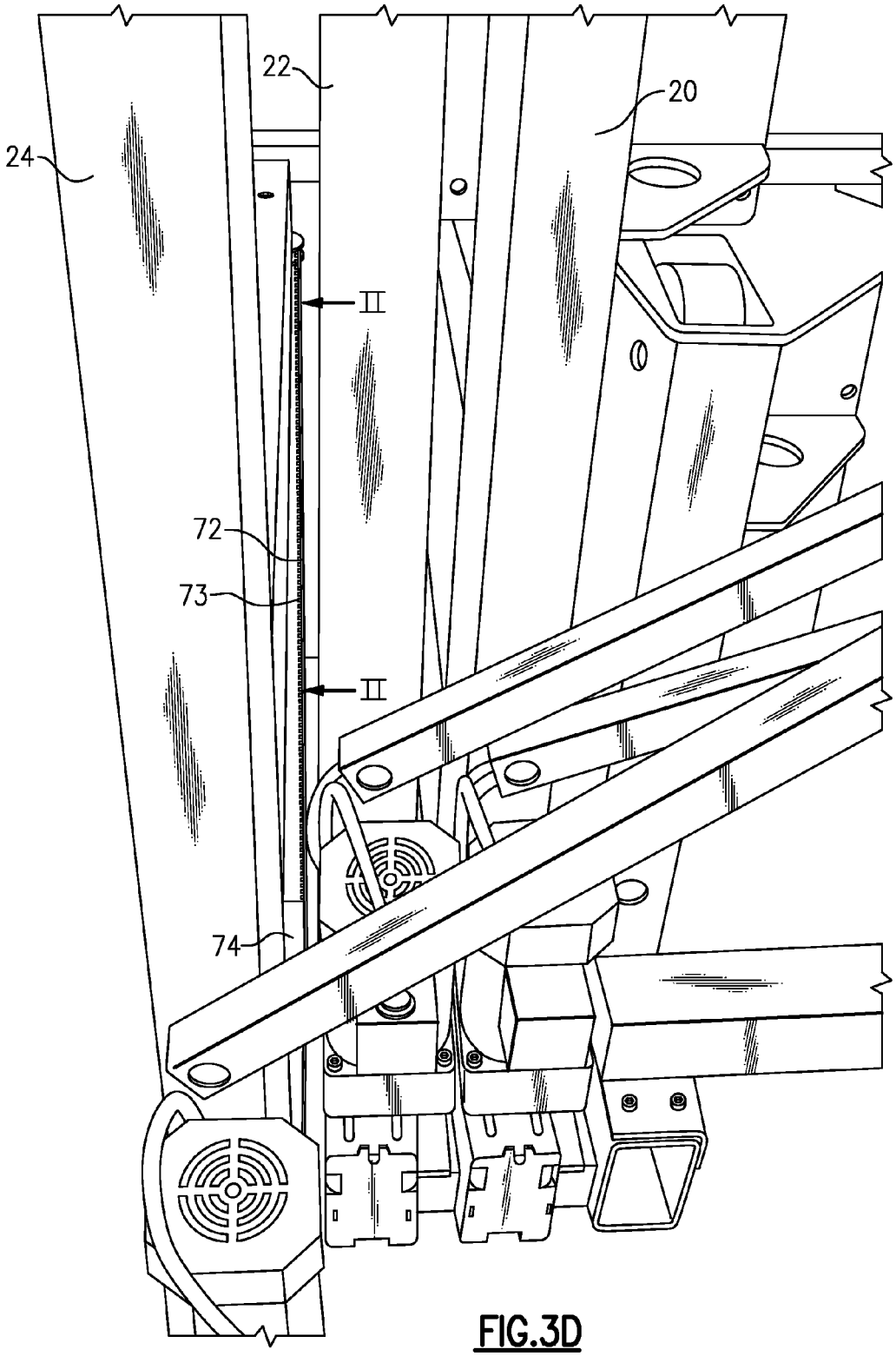
FIG. 3D is a perspective generally rear view of a multiple of the telescopic seat riser systems illustrating the tooth timing belt location.

The inner pulley 68 and the outer pulley 70 include a toothed surface to engage the toothed belt with a minimum of slippage. The example toothed surface includes a plurality of vertically extending teeth 73. The inner pulley 68 and the outer pulley 70 rotate about respective axes generally parallel to the vertical leg 52. The electric motor 66 includes a shaft 75 directly connected to the inner pulley 68. The shaft 75 rotates about an axis A that is perpendicular to the direction of movement I of the toothed timing belt 72. The direction of movement I establishes a belt plane associated with the toothed timing belt 72. The toothed timing belt 72 preferably faces away from, but is engaged with, each adjacent horizontal leg 50 of the next inner riser assembly 14-24 (FIG. 3D). That is, the toothed timing belt 72 of the belt drive system 64 on the horizontal leg 50 of the outermost riser assembly 24 faces inward toward its own horizontal leg in direction II. The belt 72, however, is engaged with the horizontal leg 50 of the next inner riser assembly 22 through a belt clamp 74 (FIG. 3H).

Figure 3E:
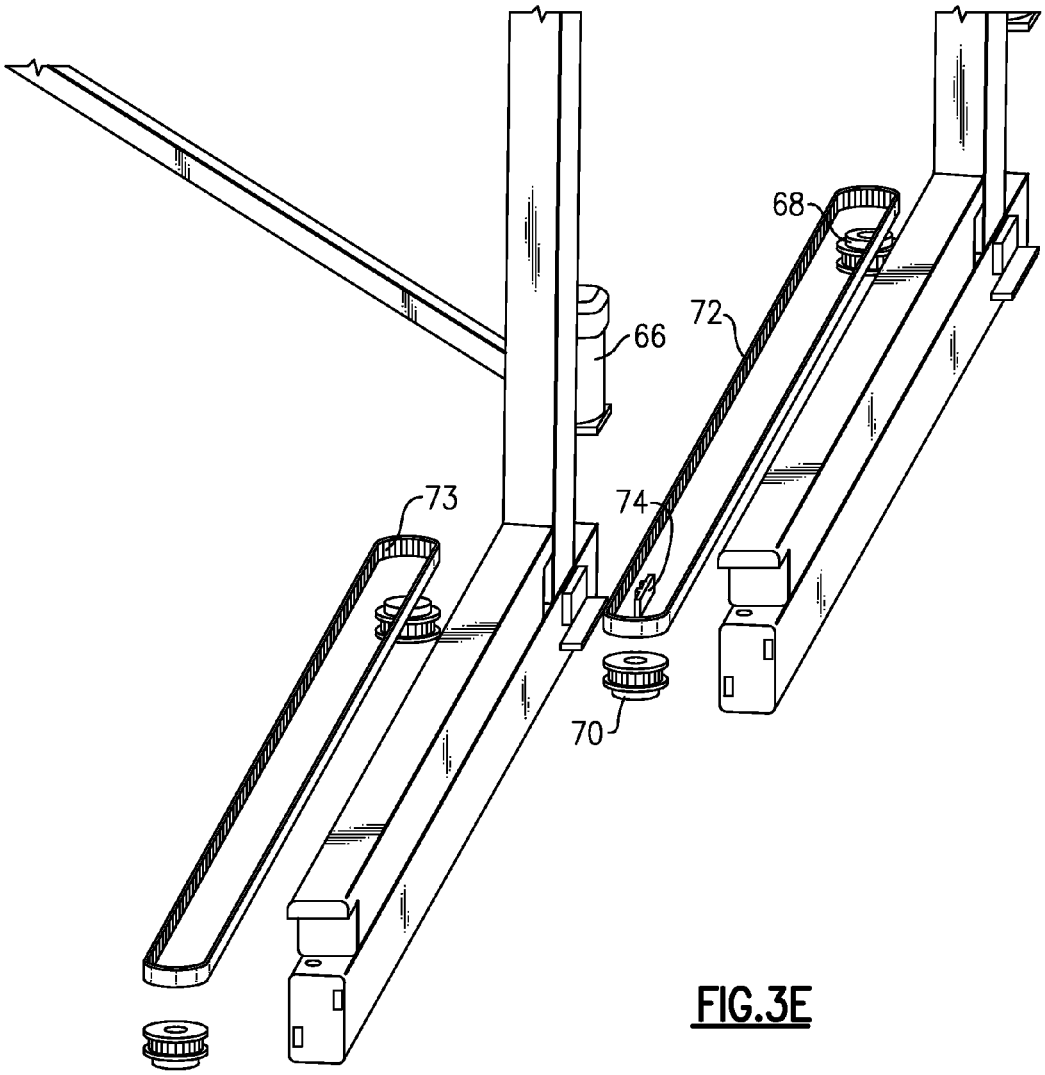
FIG. 3E is an exploded view of the tooth belt drive system.
Figure 3F:
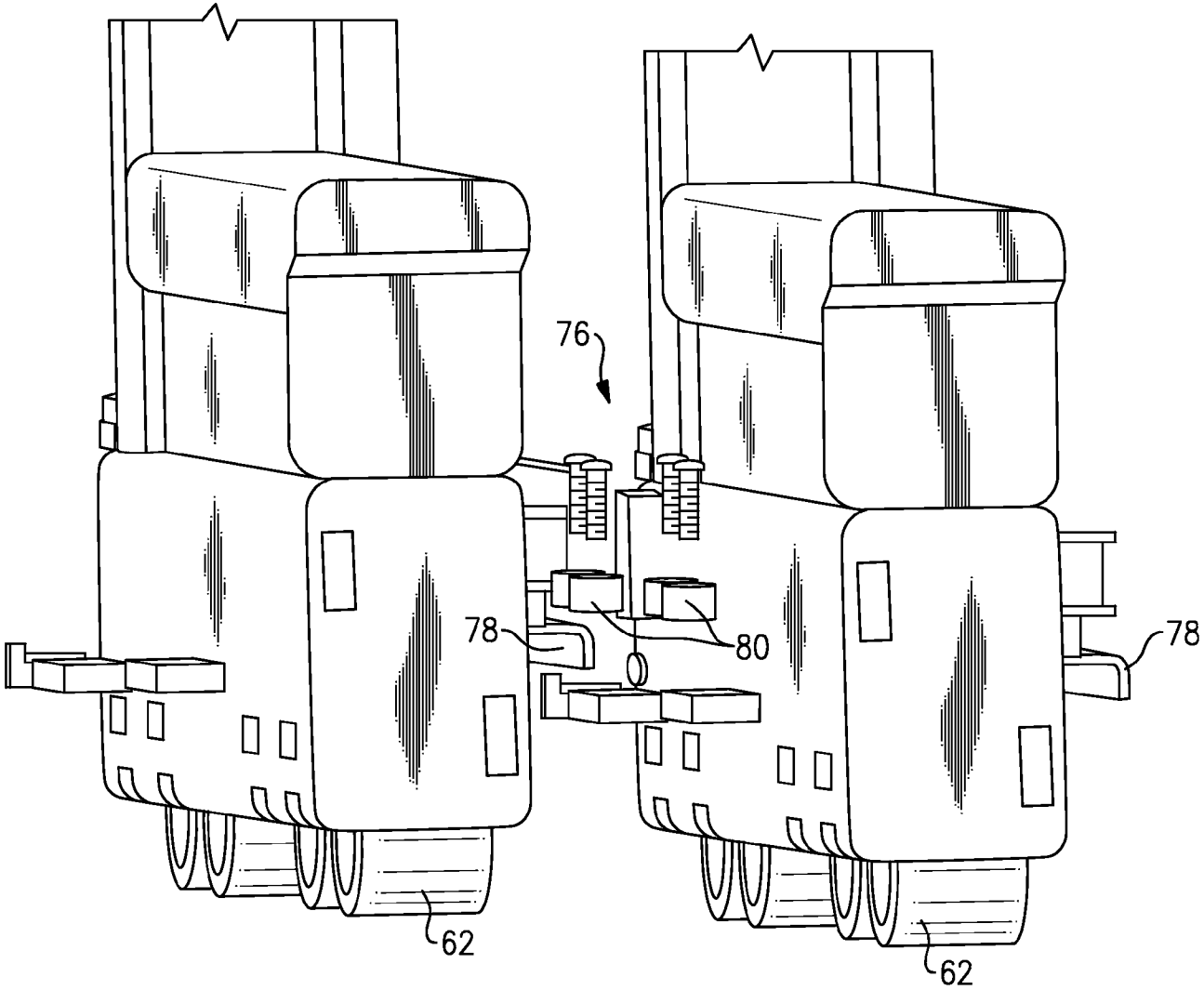
FIG. 3F is an exploded view of a guide roller assembly which movably links the riser assembly with the next adjacent riser assembly.

The toothed timing belt 72 engages the belt clamp 74 located on an outer surface of the adjacent next inner riser assembly 14-24 (FIG. 3E). Preferably, the belt clamp 74 is located adjacent the intersection of the horizontal leg 50 and the vertical leg 52 and includes a toothed surface which matches the toothed timing belt 72 for engagement therewith. The belt clamp 74 provides the engagement between the toothed timing belt 72 of the outer next inner riser assembly 14-24 with the next inner riser assembly 14-24 such that rotation of the toothed timing belt 72 drives the next inner riser assembly 14-24 relative the associated outer riser assembly 14-24.

Figure 3G:
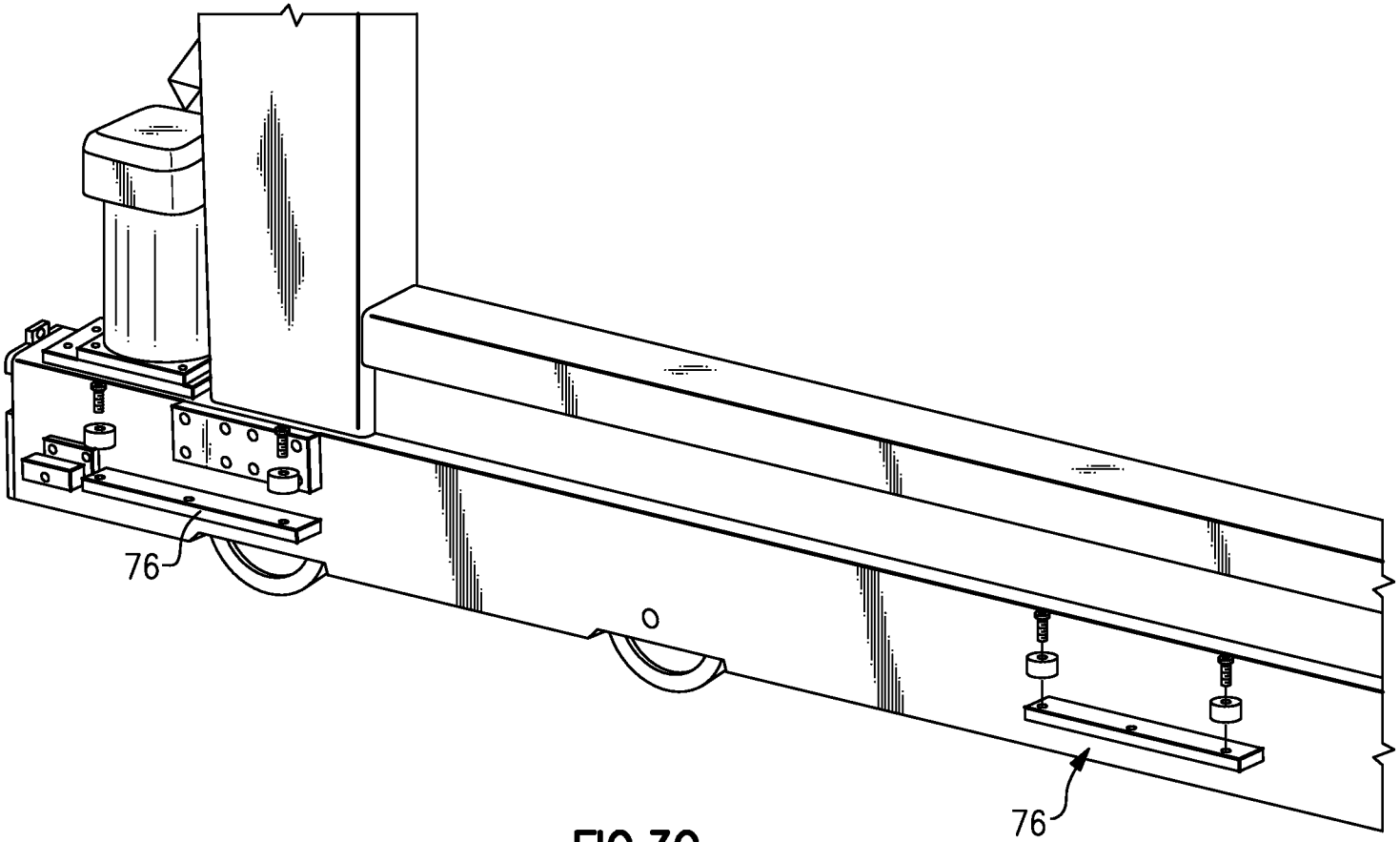
FIG. 3G is a perspective inner view of the locations of the guide assemblies for engagement with a track on an adjacent riser assembly.
Figures 3H, 4:
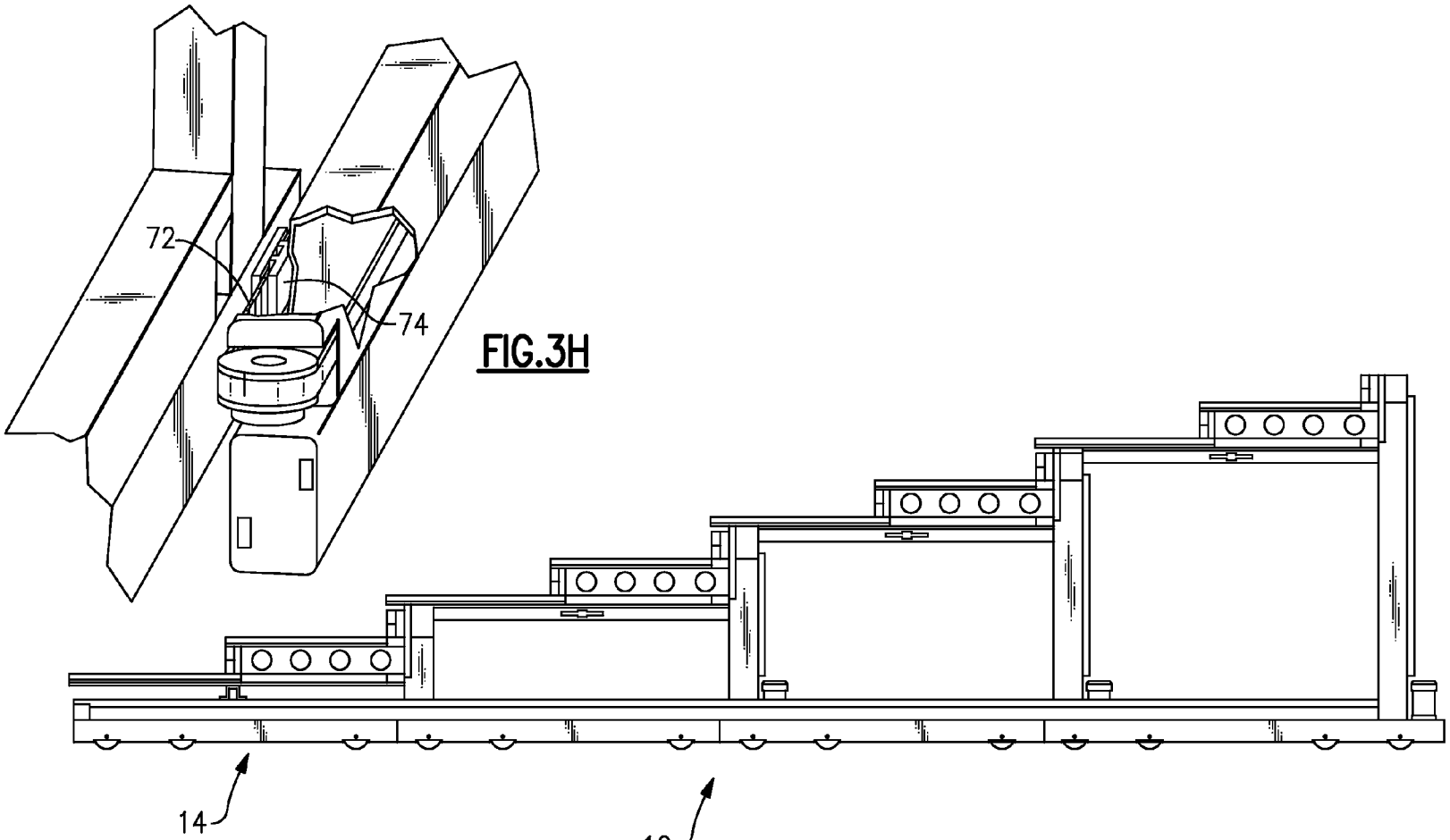
FIG. 3H is a view of the tooth belt drive system in an assembled position.
FIG. 4 is a side view of a section of a non-permanent seating system in a fully deployed position.

Referring to FIG. 3B, a guide assembly 76 along the length of the horizontal leg 50 further guides the inner riser assembly 14-24 relative the associated outer riser assembly 14-24. Preferably, a track 78 and guider roller assembly 80 (FIG. 3G) provides an effective low friction interface between one inner riser assembly 14-24 and the next associated outer riser assembly 14-24. It should be understood that various guide assemblies 76 may be utilized with the present invention.

Figure 2D:
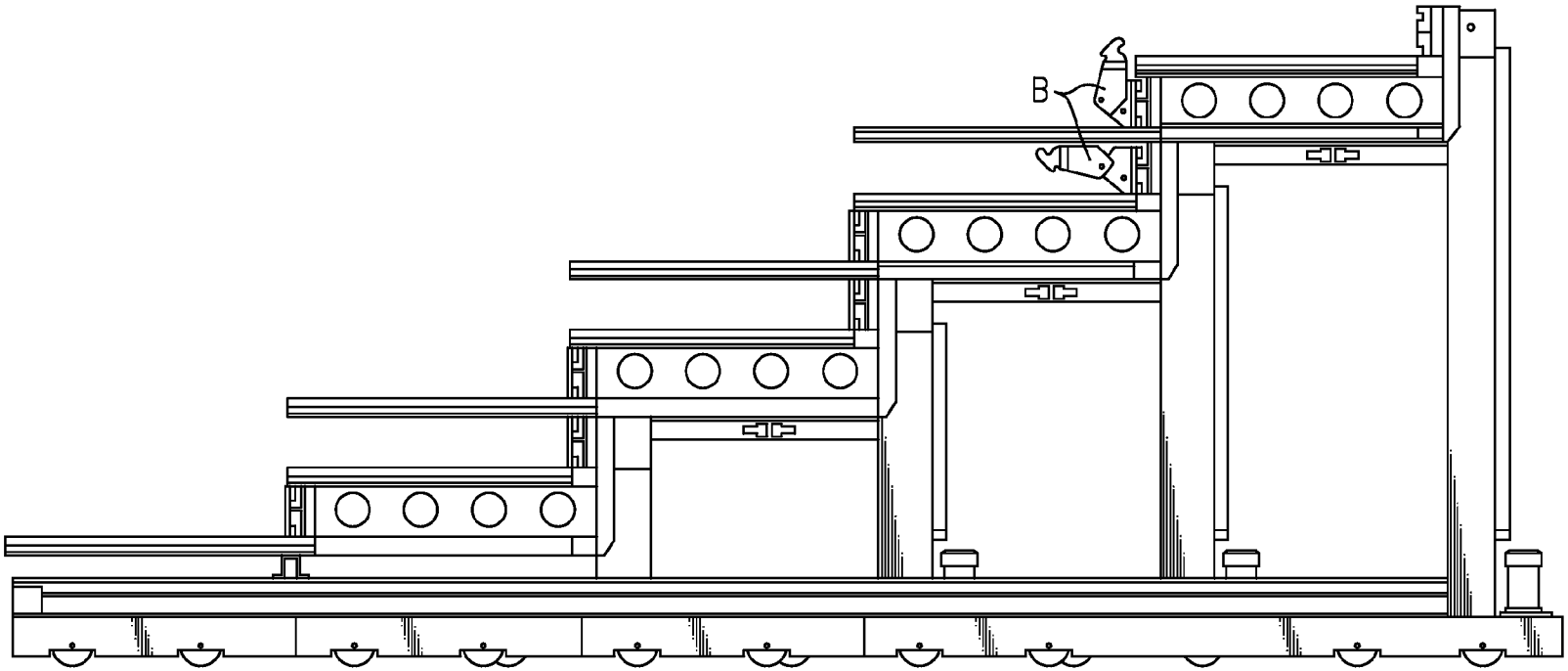
FIG. 2D is a side view of a section of a non-permanent seating system in a half-deployed position in which only half the seating capacity of each riser assembly is utilized but each seating row provides twice the rise.
Figure 2E:
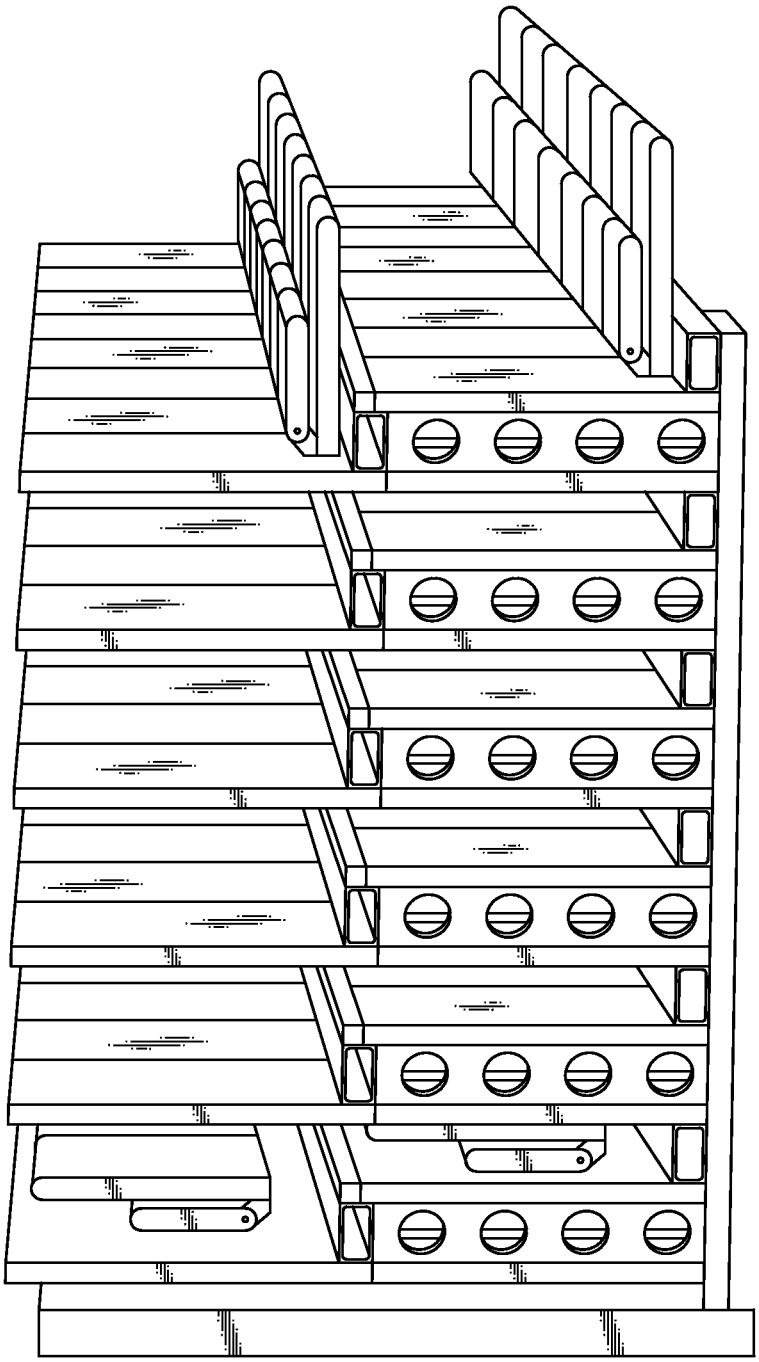
FIG. 2E is a perspective view of the non-permanent seating system in a stored position.
Figures 1, 2F:
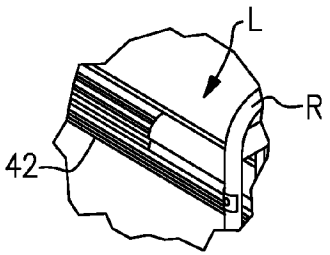
FIG. 2F is a perspective view of the non-permanent seating system illustrating one arrangement of rails and stair blocks therefore.
Figures 2, 2F:
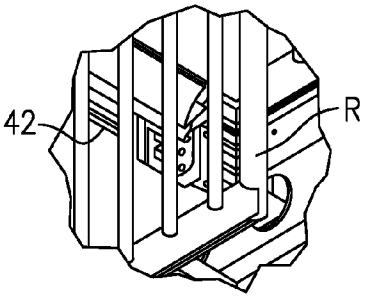
Figure 2F:
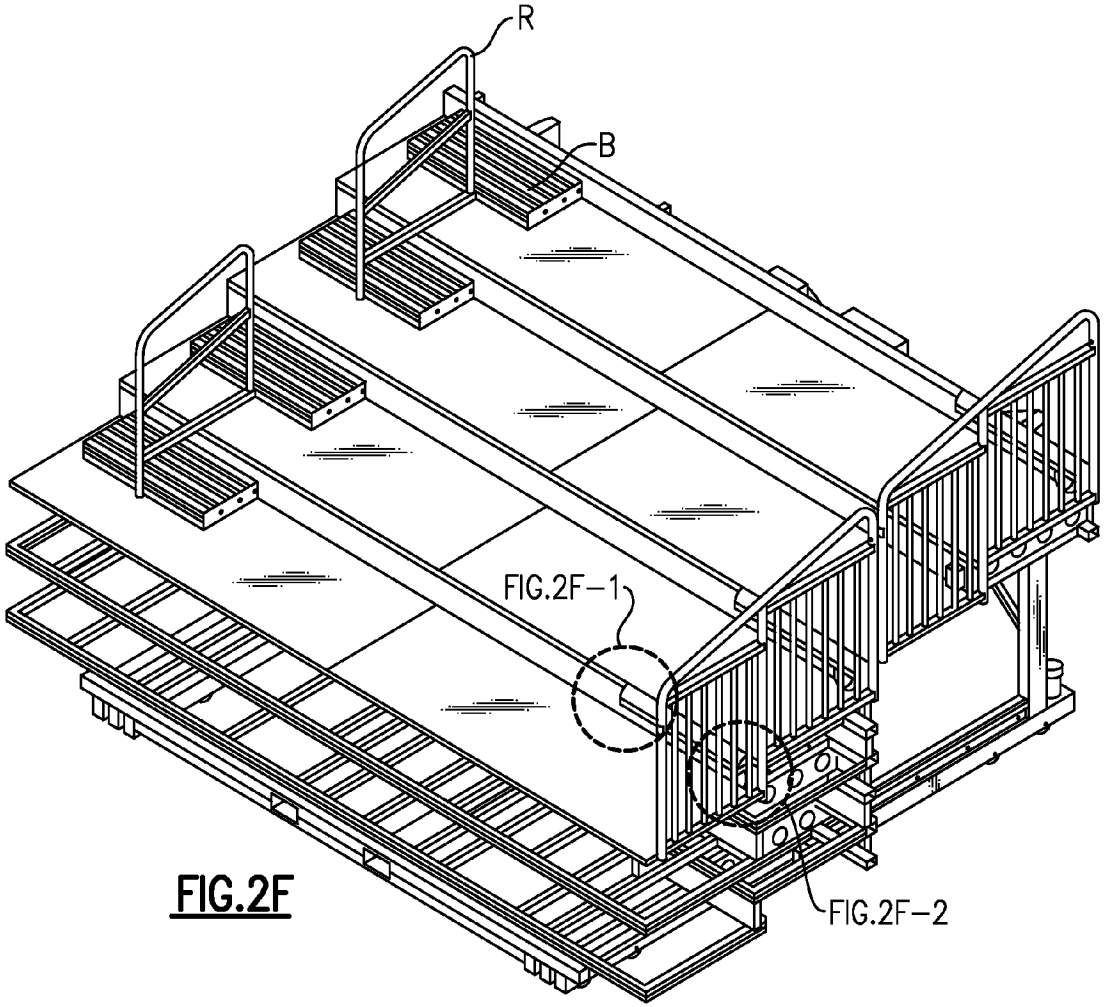

In operation, the pair of each electric motors 66 on each riser assembly 14-24 are driven simultaneously by the controller C to fully extend the seating riser system 12 from the storage position (FIG. 2E). The controller C provides for programmed stops of each riser assembly 14-24 such that the telescopic seating system 10 may be readily deployed to the fully extended position (FIGS. 1 and 4) or to the half-deployed position (FIG. 2D). The half-deployed position utilizes only half the seating capacity of each riser assembly 14-24 but provides twice the rise between each seating row to thereby accommodate particular venues. The controller C also communicates with each motor 66 such that the telescopic seating system 10 can be assured of straight tracking through torque sensing. Furthermore, the belt drive system 64 assures coordinated deployment as the toothed timing belt 72 minimizes the likelihood of slippage.

It will be appreciated that seating system is a load bearing structure intended to hold many people and equipment, such as portable seating, above a floor surface. Therefore, the telescopic seating system is suitably constructed. For instance, the structural members of the telescopic seating system preferably are constructed of thin wall tubing, straight bar stock, right angle bar stock, and plate of suitable materials, for instance, steel, alloy, aluminum, wood or high strength plastics. Components may be joined in any number of conventional manners, such as by welding, gluing or with suitable fasteners. Wheels are preferably of the solid caster type. It will be appreciated that in reference to the wheels, such wheels may be constructed of any device that provides rolling or other relative movement, such as sliding, between respective track surfaces.

It should be understood that relative positional terms such as "forward," "aft," "upper," "lower," "above," "below," and the like are with reference to the normal operational attitude of the system and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A riser assembly comprising:

a first skin;

a second skin spaced from said first skin;

a core disposed between said first skin and said second skin, said core including a plurality of subpanels;

a framework including a plurality of beams disposed between said first skin and said second skin, said core being received within a space defined by said framework, and a portion of said framework positioned laterally outside said core, each of said plurality of subpanels being received within one of a plurality of spaces defined by said framework, and said plurality of beams defining a perimeter about each of said subpanels, wherein said first skin, said second skin and said framework enclose said core, wherein said first skin and said second skin are separate and distinct from said framework;

wherein said first skin, said second skin and said framework define a first deck surface, said framework extends below a second deck surface vertically spaced from said first deck surface, and said framework extends in a horizontal direction substantially between a front facing edge and a rear facing edge of said second deck surface; and wherein said framework is a lower framework, said second deck surface includes an upper framework that is vertically spaced from and positioned in a stepped arrangement relative to said first deck surface, said first deck surface is attached to said second deck surface to minimize relative movement therebetween, and said lower framework is dimensioned to span a perimeter of said upper framework.

2. The assembly as recited in claim 1, wherein said first skin includes a first material, said second skin includes a second material, and said core includes a third material different from said first and second materials in composition.

3. The assembly as recited in claim 2, wherein said third material includes an end-grained balsawood.

4. The assembly as recited in claim 1, wherein said core comprises a honeycomb structure.

5. The assembly as recited in claim 1, comprising an access track beam arranged adjacent to said framework, said access track beam defining a longitudinal slot extending at least partially between each end of said access track beam, said longitudinal slot being configured to selectively receive a mountable accessory.

6. The assembly as recited in claim 1, wherein each of said first and second skins is glued to said core.

7. The assembly as recited in claim 1, wherein each of said first and second skins is attached to said lower framework.

8. The assembly as recited in claim 7, wherein each of said first and second skins is welded to said lower framework.

9. The assembly as recited in claim 1, wherein each of said first and second skins has a substantially identical cross-section profile spanning said core and said lower framework.

10. The assembly as recited in claim 1, comprising:

an access track beam spaced from surfaces of said lower framework to define a longitudinal slot extending substantially between said opposed side facing edges of said second deck surface; and a plurality of ribs extending in a horizontal direction substantially between said front facing and rear facing edges of said upper framework, said plurality of ribs bounded vertically by said upper framework and said lower framework.

11. A riser assembly comprising:

an upper framework and a lower framework spaced vertically relative to said upper framework and extending substantially between a front facing edge and a rear facing edge of said upper framework;

a deck surface; and an access track beam that is exposed and is separate and distinct from said upper and lower frameworks, the access track beam defining a first longitudinal slot together with said upper framework, the first longitudinal slot configured to receive a riser assembly accessory, wherein said first longitudinal slot is defined by a first channel formed in an upper surface of said access track beam and is also defined by a second channel formed in a lower surface of said upper framework.

12. The assembly as recited in claim 11, wherein said deck surface includes a first skin.

13. The assembly as recited in claim 11, wherein said deck surface is a first deck surface, and a second deck surface is positioned in a stepped arrangement relative to said first deck surface.

14. The assembly as recited in claim 13, wherein said first deck surface is attached to said second deck surface to minimize relative movement therebetween.

15. The assembly as recited in claim 11, wherein said deck surface is attached to said lower framework.

16. The assembly as recited in claim 11, wherein said access track beam is arranged adjacent to said upper and lower frameworks, said access track beam defining a second longitudinal slot extending at least partially between each end of said access track beam.

17. The assembly as recited in claim 15, wherein opposed sides of said access track beam are fixedly attached to said upper and lower frameworks.

18. The assembly as recited in claim 15, wherein said access track beam defines at least one flange extending inward from said first longitudinal slot.

19. The assembly as recited in claim 11, wherein said riser assembly accessory is chair beam mounting system secured to said access track beam.

20. The assembly as recited in claim 11, wherein said lower framework extends at least partially below said access track beam.

21. The assembly as recited in claim 11, wherein a lower surface of said upper framework defines a horizontal reference plane extending between said front facing and rear facing edges, said horizontal reference plane intersects said first longitudinal slot, and an upper surface of said access track beam is substantially aligned along said horizontal reference plane.

22. The assembly as recited in claim 11, wherein said access track beam abuts an upper surface of said lower framework.

23. A riser assembly comprising:

an upper framework and a lower framework spaced vertically relative to said upper framework and extending substantially between a front facing edge and a rear facing edge of said upper framework;

a deck surface; and an access track beam that is exposed and is separate and distinct boon said upper and lower frameworks, the access track beam defining a first longitudinal slot together with said upper framework, the first longitudinal slot configured to receive a riser assembly accessory, wherein said access track beam extends across and is attached to a plurality of ribs extending substantially between said front facing edge and said rear facing edge of said upper framework.

24. The assembly as recited in claim 23, wherein said deck surface includes a first skin spanning said across and sandwiched between said upper framework and each of said plurality of ribs.

25. The assembly as recited in claim 23, wherein each of said plurality of ribs is spaced apart from said first longitudinal slot.

* * * * *

UNITED STATES PATENT AND TRADEMARK OFFICE

CERTIFICATE OF CORRECTION

PATENT NO. : 9,234,361 B2
APPLICATION NO. : 14/299379
DATED : January 12, 2016
INVENTOR(S) : Kenneth Edward Staten It is certified that error appears in the above-identified patent and that said Letters Patent is hereby corrected as shown below:

IN THE CLAIMS:

In claim 23, column 9, line 14; delete “boon” and insert --from--

Signed and Sealed this
Nineteenth Day of April, 2016

Michelle K. Lee

Michelle K. Lee
*Director of the United States Patent and Trademark Office*